US007034815B2

(12) United States Patent
Neal

(10) Patent No.: US 7,034,815 B2
(45) Date of Patent: Apr. 25, 2006

(54) METHOD AND APPARATUS FOR SYNCHRONIZING AN ANALOG VIDEO SIGNAL TO AN LCD MONITOR

(75) Inventor: Greg Neal, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 912 days.

(21) Appl. No.: 10/071,409

(22) Filed: Feb. 8, 2002

(65) Prior Publication Data

US 2003/0052871 A1 Mar. 20, 2003

Related U.S. Application Data

(60) Provisional application No. 60/323,968, filed on Sep. 20, 2001.

(51) Int. Cl.
*G09G 5/00* (2006.01)

(52) U.S. Cl. ..... 345/211; 348/537; 345/213

(58) Field of Classification Search ..... 345/668–669, 345/3.1–3.4, 213, 127, 211; 348/537, 513
See application file for complete search history.

(56) References Cited

U.S. PATENT DOCUMENTS

| | | | | |
|---|---|---|---|---|
| 5,717,469 | A | 2/1998 | Jennes et al. | |
| 5,731,843 | A | 3/1998 | Cappels | |
| 5,805,233 | A | 9/1998 | West | |
| 5,841,430 | A | 11/1998 | Kurikko | |
| 5,874,937 | A | 2/1999 | Kesatoshi | |
| 6,005,557 | A | 12/1999 | Wong | |
| 6,097,437 | A | 8/2000 | Hwang | |
| 6,097,444 | A | 8/2000 | Nakano | |
| 6,268,848 | B1 | 7/2001 | Eglit | |
| 6,313,822 | B1 | 11/2001 | McKay et al. | |
| 6,313,881 | B1 * | 11/2001 | Reinhart et al. | 348/572 |
| 6,340,993 | B1 | 1/2002 | Hasegawa et al. | |
| 6,348,931 | B1 * | 2/2002 | Suga et al. | 345/699 |
| 6,452,592 | B1 | 9/2002 | Zhang et al. | |
| 6,473,131 | B1 | 10/2002 | Neugebauer et al. | |
| 6,501,310 | B1 | 12/2002 | Takami | |
| 6,522,365 | B1 | 2/2003 | Levantovsky et al. | |
| 6,559,837 | B1 | 5/2003 | Lasneski et al. | |
| 6,636,205 | B1 * | 10/2003 | Lasneski | 345/204 |

(Continued)

FOREIGN PATENT DOCUMENTS

| | | |
|---|---|---|
| JP | 10091127 | 4/1998 |

(Continued)

*Primary Examiner*—Jimmy H. Nguyen
*Assistant Examiner*—Sameer Gokhale
(74) *Attorney, Agent, or Firm*—Beyer Weaver & Thomas, LLP

(57) ABSTRACT

A method, system and apparatus for synchronizing an analog video signal to an LCD monitor is described. For each of a succession of associated video frames are surveyed for a number of displayed features based upon a pseudo-random selection of regions into which the displayed video frame is divided. During successive associated video frames, a minimum number of features each is which is generated by an associated pixel clock is determined based upon a preselected number of scans. Subsequent to the determination of the minimum number of features, a transition region for each of plurality of horizontal resolution values is determined by scanning through a selected number of pixel clock phases. Based upon a minimum transition zone corresponding to a maximum change in the number of features for a particular pixel clock phase, an associated horizontal resolution is provided.

17 Claims, 17 Drawing Sheets

U.S. PATENT DOCUMENTS

| | | | | |
|---|---|---|---|---|
| 6,664,977 | B1 | 12/2003 | Masumoto | |
| 6,724,381 | B1 | 4/2004 | Sakashita | |
| 6,734,919 | B1 | 5/2004 | Champion et al. | |
| 6,750,855 | B1 | 6/2004 | Von Hase | |
| 6,753,926 | B1 | 6/2004 | Nishino | |
| 6,856,659 | B1 * | 2/2005 | Pierrick | 375/355 |
| 2001/0022523 | A1 | 9/2001 | Takami | |
| 2002/0080280 | A1 | 6/2002 | Champion et al. | |
| 2003/0052872 | A1 | 3/2003 | Neal | |
| 2003/0052898 | A1 | 3/2003 | Neal | |

FOREIGN PATENT DOCUMENTS

| | | |
|---|---|---|
| JP | 10153989 | 6/1998 |

* cited by examiner

METHOD AND APPARATUS FOR SYNCHRONIZING AN ANALOG VIDEO SIGNAL TO AN LCD MONITOR

CROSS REFERENCE TO RELATED APPLICATIONS

This application takes priority under 35 U.S.C. § 119 (e) of U.S. Provisional Patent Application No. 60/323,968 entitled "METHOD AND APPARATUS FOR SYNCHRONIZING AN ANALOG VIDEO SIGNAL TO AN LCD MONITOR" by Neal filed Sep. 20, 2001 which is incorporated by reference in its entirety for all purposes.

BACKGROUND OF THE INVENTION

I. Field of the Invention

The invention relates to liquid crystal displays (LCDs). More specifically, the invention describes a method and apparatus for automatically determining a horizontal resolution and associated pixel clock rate.

II. Description of the Related Art

Digital display devices generally include a display screen including a number of horizontal lines. The number of horizontal and vertical lines defines the resolution of the corresponding digital display device. Resolutions of typical screens available in the market place include 640×480, 1024×768 etc. At least for the desk-top and laptop applications, there is a demand for increasingly bigger size display screens. Accordingly, the number of horizontal display lines and the number of pixels within each horizontal line has also been generally increasing.

In order to display a source image on a display screen, each source image is transmitted as a sequence of frames each of which includes a number of horizontal scan lines. Typically, a time reference signal is provided in order to divide the analog signal into horizontal scan lines and frames. In the VGA/SVGA environments, for example, the reference signals include a VSYNC signal and an HSYNC signal where the VSYNC signal indicates the beginning of a frame and the HSYNC signal indicates the beginning of a next source scan line. Therefore, in order to display a source image, the source image is divided into a number of points and each point is displayed on a pixel in such a way that point can be represented as a pixel data element. Display signals for each pixel on the display may be generated using the corresponding display data element.

However, in some cases, the source image may be received in the form of an analog signal. Thus, the analog data needs to be converted into pixel data for display on a digital display screen. In order to convert the source image received in analog signal form to pixel data suitable for display on a digital display device, each horizontal scan line must be converted to a number of pixel data. For such a conversion, each horizontal scan line of analog data is sampled a predetermined number of times (HTOTAL) using a sampling clock signal (i.e., pixel clock). That is, the horizontal scan line is usually sampled during each cycle of the sampling clock. Accordingly, the sampling clock is designed to have a frequency such that the display portion of each horizontal scan line is sampled a desired number of times ($H_{TOTAL}$) that corresponds to the number of pixels on each horizontal display line of the display screen.

In general, a digital display unit needs to sample a received analog display signal to recover the pixel data elements from which the display signal was generated. For accurate recovery, the number of samples taken in each horizontal line needs to equal $H_{TOTAL}$. If the number of samples taken is not equal to $H_{TOTAL}$, the sampling may be inaccurate and resulting in any number and type of display artifacts (such as moire patterns).

Therefore what is desired is an efficient method and apparatus for determining a horizontal resolution of an analog video signal suitable for display on a fixed position pixel display such as an LCD.

SUMMARY OF THE INVENTION

According to the present invention, methods, apparatus, and systems are disclosed for determining a horizontal resolution of an analog video signal suitable for display on a fixed position pixel display such as an LCD.

In one embodiment, an apparatus for synchronizing an analog video signal formed of a plurality of associated video frames to a digital image formed of a plurality of pixels displayed on a digital display unit is described. The apparatus includes means for determining a synchronizing horizontal resolution (Htotal) that includes and means for finding a plurality of features for a selected one of a range of Htotal. The apparatus also includes means for tracking each of the plurality of features for each of the range of Htotal, means for measuring a transition zone for each of the plurality of found features for each of the range of Htotal, and means for determining the narrowest transition zone of the plurality of transition zones. The apparatus further includes means for associating a particular one of the range of Htotal corresponding to the narrowest transition zone to the synchronizing horizontal resolution and means for determining a synchronizing phase coupled to the means for determining the synchronizing horizontal resolution that includes, means for selecting an estimated phase based upon the synchronizing horizontal resolution, means for determining a flat region of a video signal corresponding to a selected found feature, and means for selecting the synchronizing phase based upon the flat region.

In another embodiment, a method of synchronizing an analog video signal formed of a plurality of associated video frames to a digital image formed of a plurality of pixels displayed on a digital display unit is described. A synchronizing horizontal resolution (Htotal) is determined by finding a plurality of features for a selected one of a range of Htotal. Next, each of the plurality of features is tracked for each of the range of Htotal and a transition zone is measured for each of the plurality of found features for each of the range of Htotal. Next, the narrowest transition zone of the plurality of transition zones is determined and then a particular one of the range of Htotal corresponding to the narrowest transition zone is associated with the synchronizing horizontal resolution. After the horizontal resolution is determined, a synchronizing phase is determined by selecting an estimated phase based upon the synchronizing horizontal resolution after which a flat region of a video signal corresponding to a selected found feature is determined. The synchronizing phase is determined based upon the flat region.

In yet another embodiment of the invention, a system for synchronizing an analog video signal formed of a plurality of associated video frames to a digital image formed of a plurality of pixels displayed on a digital display unit is described. The system includes a video signal evaluator arranged to provide an estimate of the synchronizing resolution, a feature finder unit arranged to find a feature, if any, associated with a pseudo-randomly selected pixel, a transition zone generator unit coupled to the feature finder unit arranged to generate a transition zone associated with the found feature based upon the estimated synchronizing resolution, and a minimum transition zone evaluator unit coupled to the transition zone detector for evaluating a minimum transition zone corresponding to the synchronizing resolution.

BRIEF DESCRIPTION OF THE DRAWINGS

The invention will be better understood by reference to the following description taken in conjunction with the accompanying drawings.

DETAILED DESCRIPTION OF SELECTED EMBODIMENTS

Reference will now be made in detail to a particular embodiment of the invention an example of which is illustrated in the accompanying drawings. While the invention will be described in conjunction with the particular embodiment, it will be understood that it is not intended to limit the invention to the described embodiment. To the contrary, it is intended to cover alternatives, modifications, and equivalents as may be included within the spirit and scope of the invention as defined by the appended claims.

In one embodiment, a method for determining a horizontal resolution ($H_{TOTAL}$) is described. Each of a succession of associated video frames are surveyed for a number of displayed features based upon a pseudo-random selection of regions into which the displayed video frame is divided. During successive associated video frames, a minimum number of features is determined based upon a pre-selected number of scans. Subsequent to the determination of the minimum number of features, a transition region for each of plurality of horizontal resolution values ($H_{TOTAL}$) is determined. Based upon a minimum transition zone, an associated $H_{TOTAL}$ is provided.

The invention will now be described in terms of an analog video signal synchronizer unit capable of providing a horizontal resolution ($H_{TOTAL}$) and a pixel clock $P_{\phi}$ and methods thereof capable of being incorporated in an integrated semiconductor device well known to those skilled in the art. It should be noted, however, that the described embodiments are for illustrative purposes only and should not be construed as limiting either the scope or intent of the invention.

Figure 1:
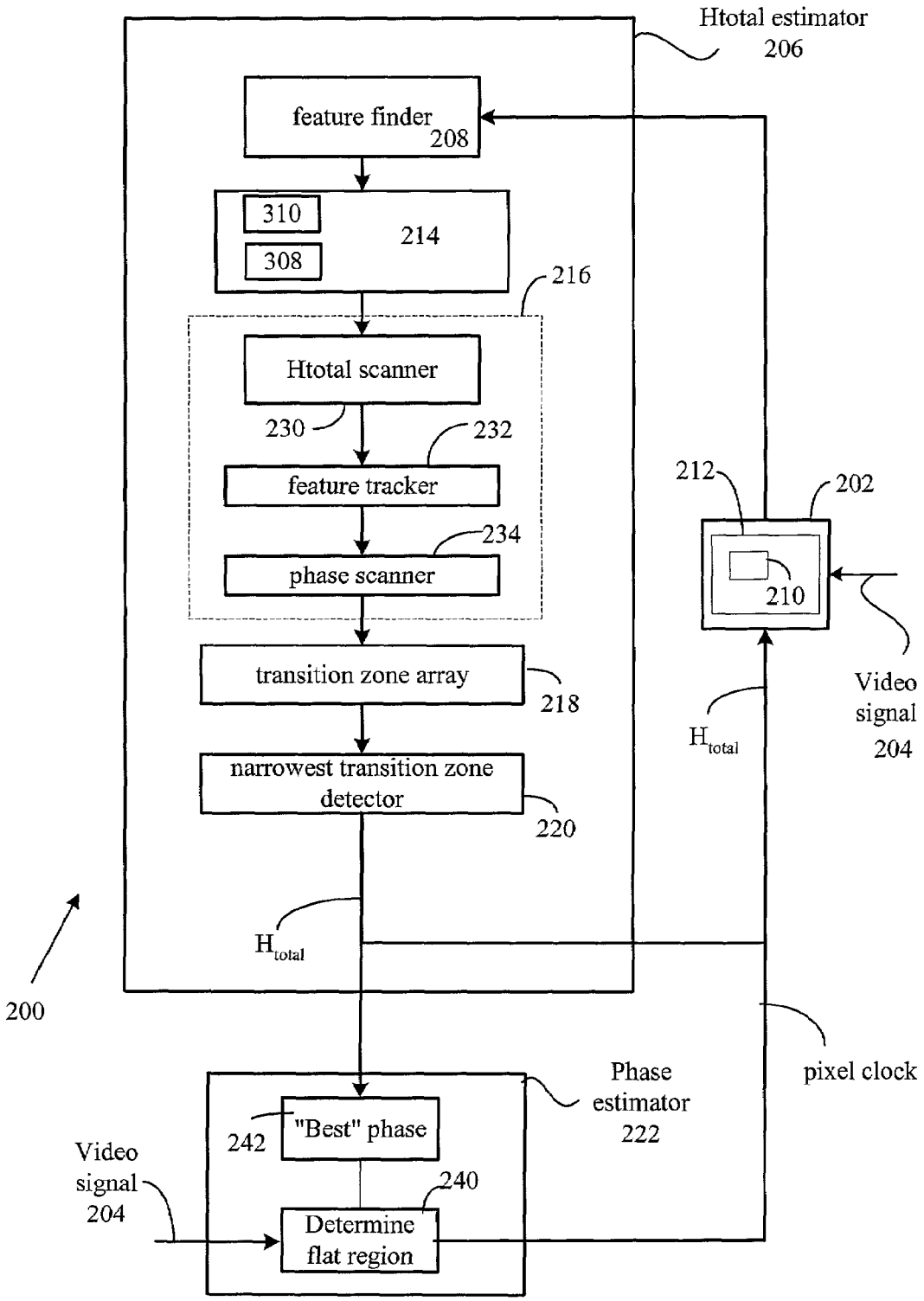
FIG. 1 shows an analog video signal synchronizer unit in accordance with an embodiment of the invention.

Accordingly, FIG. 1 shows an analog video signal synchronizer unit 200 in accordance with an embodiment of the invention. In the described embodiment, the analog video signal synchronizer unit 200 is coupled to an exemplary digital display 202 (which in this case is an LCD 202) capable of receiving and displaying an analog video signal 204 from analog video source (not shown). It should be noted that the analog video signal synchronizer unit 200 can be implemented in any number of ways, such as a integrated circuit, a pre-processor, or as programming code suitable for execution by a processor such as a central processing unit (CPU) and the like. In the embodiment described, the video signal synchronizer unit 200 is typically part of an input system, circuit, or software suitable for pre-processing video signals derived from the analog video source such as for example, an analog still camera, and the like that can also include a digital visual interface (DVI).

In the described embodiment, the analog video signal synthesizer unit 200 includes a horizontal resolution estimator 206 arranged to provide a horizontal resolution value ($H_{TOTAL}$) corresponding to the video signal 204 as well as a pixel clock phase based, in part, upon $H_{TOTAL}$ as well as the video signal 204. The synthesizer unit 200 includes a feature finder 208 arranged to detect a feature 210 within an active display region 212 of the LCD 202. Once the feature finder 208 has detected, or found, the feature 210, the coordinates of the found feature 210 are stored in a found feature location array 214 coupled to the feature finder unit 208. Once all the coordinates of all the found features 210 are stored in the array 214, a transition zone detector 216 detects a number of transition zones described below that are subsequently stored in a transition zone array 218 coupled thereto. A narrowest transition zone detector 220 coupled to the transition zone array 218 detects a narrowest transition zone that corresponds to a correct horizontal resolution $H_{TOTAL}$.

Once $H_{TOTAL}$ has been determined by the horizontal resolution estimator 206, a pixel clock phase estimator 222 coupled thereto provides a best estimate of a pixel clock phase (Ø) based in part upon $H_{TOTAL}$ and the video signal 204. In the described embodiment, the pixel clock phase estimator 222 uses $H_{TOTAL}$ to provide a first estimate $P_{Ø1}$ of the pixel clock phase $P_{Ø}$ which is used as a initial condition for scanning a flat region of the video signal 204 in order to confirm the validity (or not) of the first estimate $P_{Ø1}$ as the best estimate of the pixel clock phase $P_{Ø}$. In this way, the analog video signal synchronizer unit 200 is capable of providing both $H_{TOTAL}$ and the pixel clock phase $P_{Ø}$ most consistent with the analog video signal 204 thereby providing the best "fit" of the image associated with the analog video signal 204 to the LCD 202. In those cases where the first estimate $P_{\varnothing 1}$ is not the best fit, a second estimate $P_{\varnothing 2}$ is generated, and so on, until a best fit of the image is obtained.

The following discussion describes operation of the analog video signal synchronizer unit 200 in accordance with a particular implementation of the invention. It should be noted, however, that the described operation is only one possible implementation and should therefore not be considered to be limiting either the scope or intent of the invention.

Figure 2A:
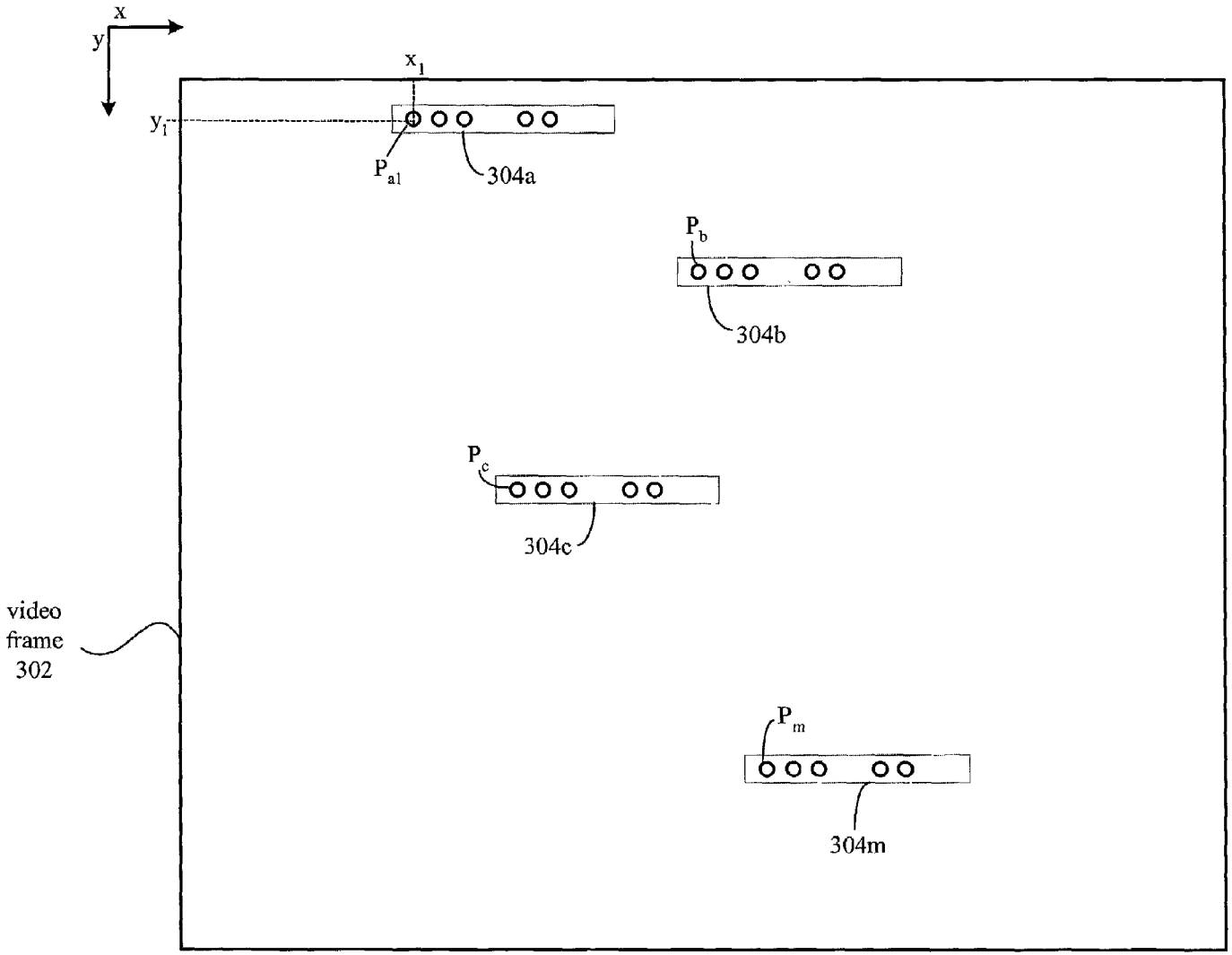
FIGS. 2A–2B graphically illustrate finding a feature in accordance with an embodiment of the invention.

In operation, the feature finder 208 begins a feature search by pseudo-randomly selecting a number of pixels included in a first video frame 302 that are displayed in the active area display 212 as shown in FIG. 2A. For example, the feature finder 208 begins by pseudo-randomly selecting a number of pixels $P_a$–$P_m$ included in the frame 302 each of which is associated with a region 304*a*–304*m*. It should be noted that in the described embodiment, the regions 304*a*–304*m* are formed of a group of associated horizontal pixels but can, of course, be any appropriately arranged group of pixels such as, for example, a rectangular range of pixels.

Figure 2B:
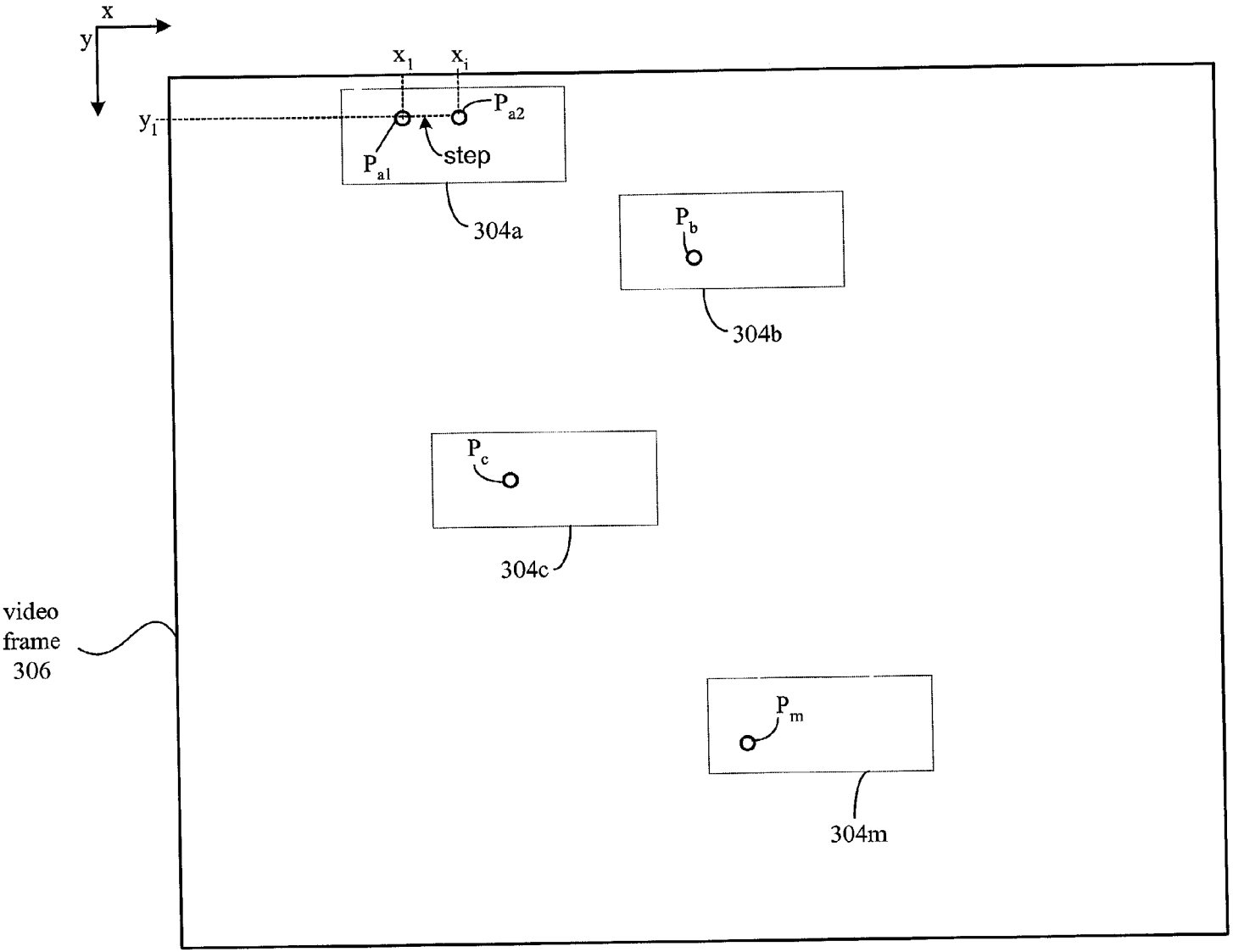

In the described embodiment, the feature finder 208 then stores for each first pixel in each region (such as, for example, pixel $P_1$ of the region 304*a*) an associated first pixel video signal value $P_{1val}$ in, for example, a register (not shown) or other such data latch. Using the region 304*a* as an example, during a subsequent video frame 306, the feature finder 208 selects a second pixel coordinate $(x_i,y_1)$ associated with a second pixel P2 as shown in FIG. 2B by incrementing the x pixel coordinate only of the first pixel coordinate $(x_1,y_1)$ and storing an associated second pixel video signal value $P_{2val}$ associated with the second pixel P2. At this point, the feature finder 208 compares an absolute value of the first pixel video signal value $P_{1val}$ to an absolute value of the second pixel video signal value $P_{2val}$ according to equation 1:

$$\text{Edge}=Abs\{P_{1val}\}-Abs\{P_{2val}\} \qquad \text{equation 1.}$$

If a value of Edge is positive, then the second pixel P2 corresponds to what is referred to as a rising edge type pixel associated with a rising edge feature. Conversely, if the value of Edge is negative, then the second pixel P2 corresponds to a falling edge pixel corresponding to a falling edge feature. It should be noted that at this point, all coordinates corresponding to all rising edge features and falling edge features so found are stored, respectively, in a rising edge array 308 and a falling edge array 310 as part of the found feature array 214. In some embodiments, the total number of found features are tallied and compared to a minimum number of found features. In some embodiments, this minimum number can be as low as four or as high as 10 depending on the situation at hand. This is done in order to optimize the ability to ascertain $H_{TOTAL}$ since too few found features can provide inconsistent results.

Figure 3A:
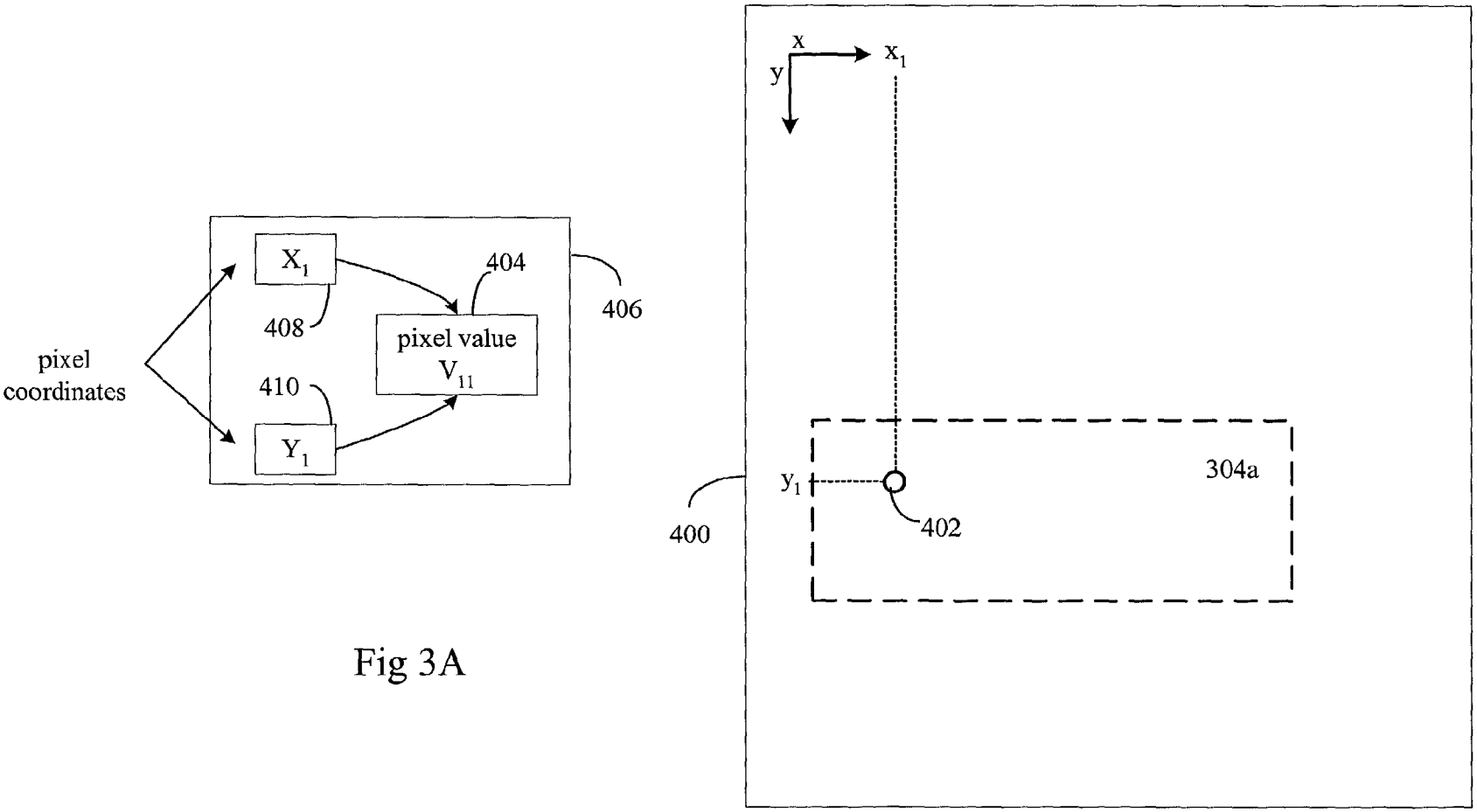
FIGS. 3A–3B graphically illustrate a particular implementation of a finding the feature shown in FIGS. 2A–2B.
Figure 3B:
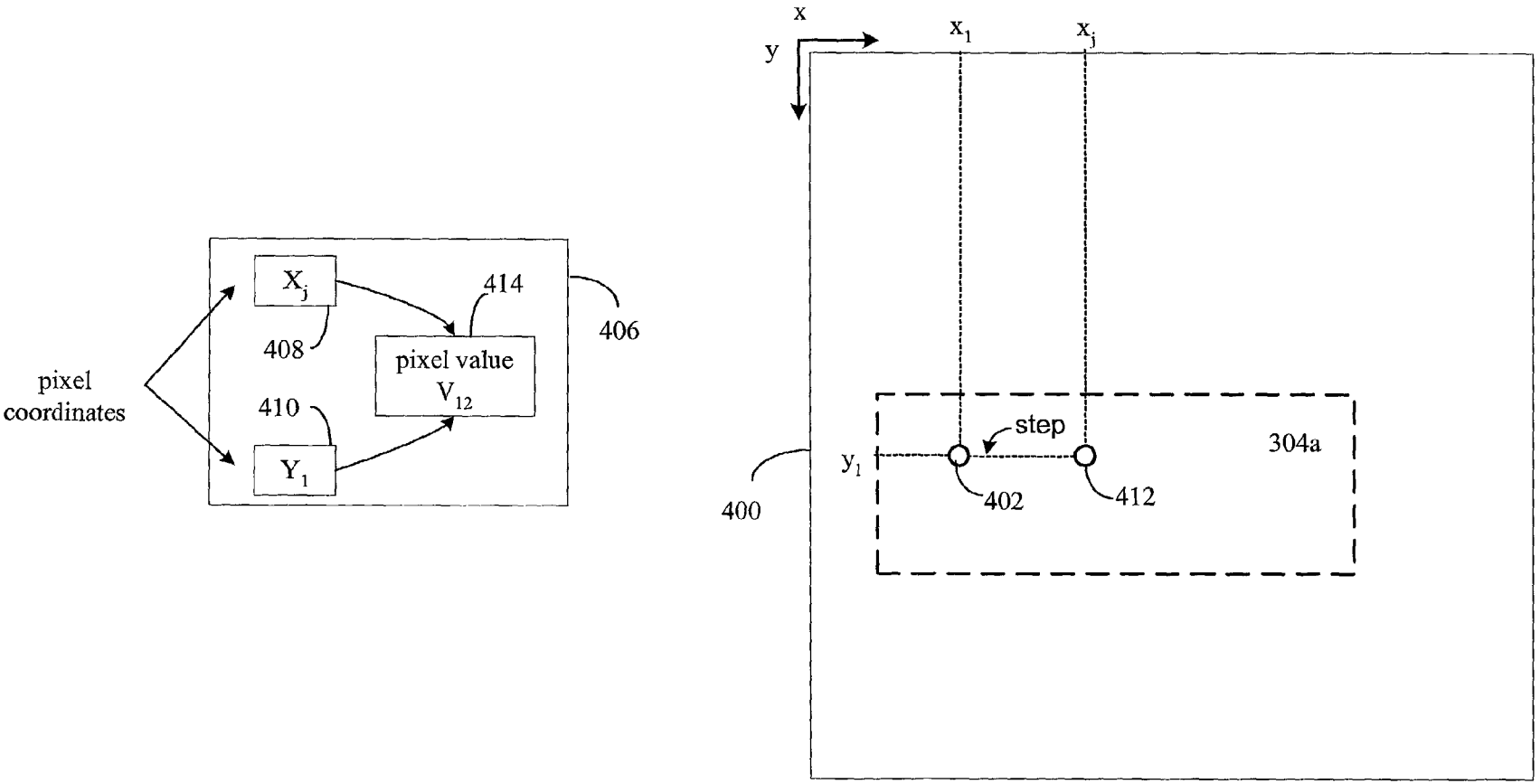

A more detailed example of the procedure followed by the feature finder 208 is further illustrated in FIGS. 3A–3B using the found feature 210 in the region 304*a* as an example. Accordingly, during a frame 400 the feature finder 208 randomly selects a first pixel 402 (which for this example, is located at coordinates $(x_1, y_1)$) included in the region 304*a*. At this point, a pixel value $V_{11}$ associated with the first pixel 402 is stored in a register 404 using what is referred to as a pixel grabber 406. It should be noted that the pixel grabber 406 operates by specifying a particular pixel coordinate set $(x_i, y_j)$ in, respectively, an x coordinate register 408 and a y coordinate register 410 the pixel value of which is stored in the register 404. In the example shown in FIG. 3A, the pixel value of the first pixel 402 is substantially zero.

During a next scan (i.e., during a subsequent video frame) shown in FIG. 3B, the value of the x coordinate is incremented by a specified step value STEP whereas the y coordinate value remains constant. It should be noted that the specified step value STEP can be, for example, a single pixel step or for that matter, any appropriate multi-pixel step. In the case shown in FIG. 3B, a second pixel 412 is therefore associated with the next pixel location of $(x_j, y_1)$ where $x_j$ represents an x coordinate that is the step increment value STEP displaced from the initial x coordinate $x_1$ (i.e., $x_j=x_1+$ STEP). At this point, the pixel value $V_{12}$ associated with the second pixel 412 is stored in a register 414 and compared to the previous pixel value $V_{11}$. Since the value $V_{12}$ is greater than the value $V_{11}$, the second pixel 412 corresponds to a rising edge feature corresponding to the feature 210. The region 304*a* is now marked as used since a feature (either falling or rising edge) has been located therein.

Once a predetermined number of scans has been completed (each of which corresponds to a different video frame), a determination is made whether or not a sufficient number of features have been found. It should be noted that once a feature is found and the corresponding region is marked as used, then that particular region is no longer subject to the pixel by pixel evaluation. In one embodiment, a minimum number of found features can be as low as four whereas a desired number of found features can be as many as ten or more. In this way, the likelihood of providing an accurate and reliable estimate of the horizontal resolution $H_{TOTAL}$ is substantially enhanced.

Although only the region 304*a* has been used in this example, it is well to note that the above describe procedure is performed substantially simultaneously on all the pseudo-randomly selected pixels $P_a$ through $P_m$ and their associated regions 304*a* through 304*m*.

Figure 4A:
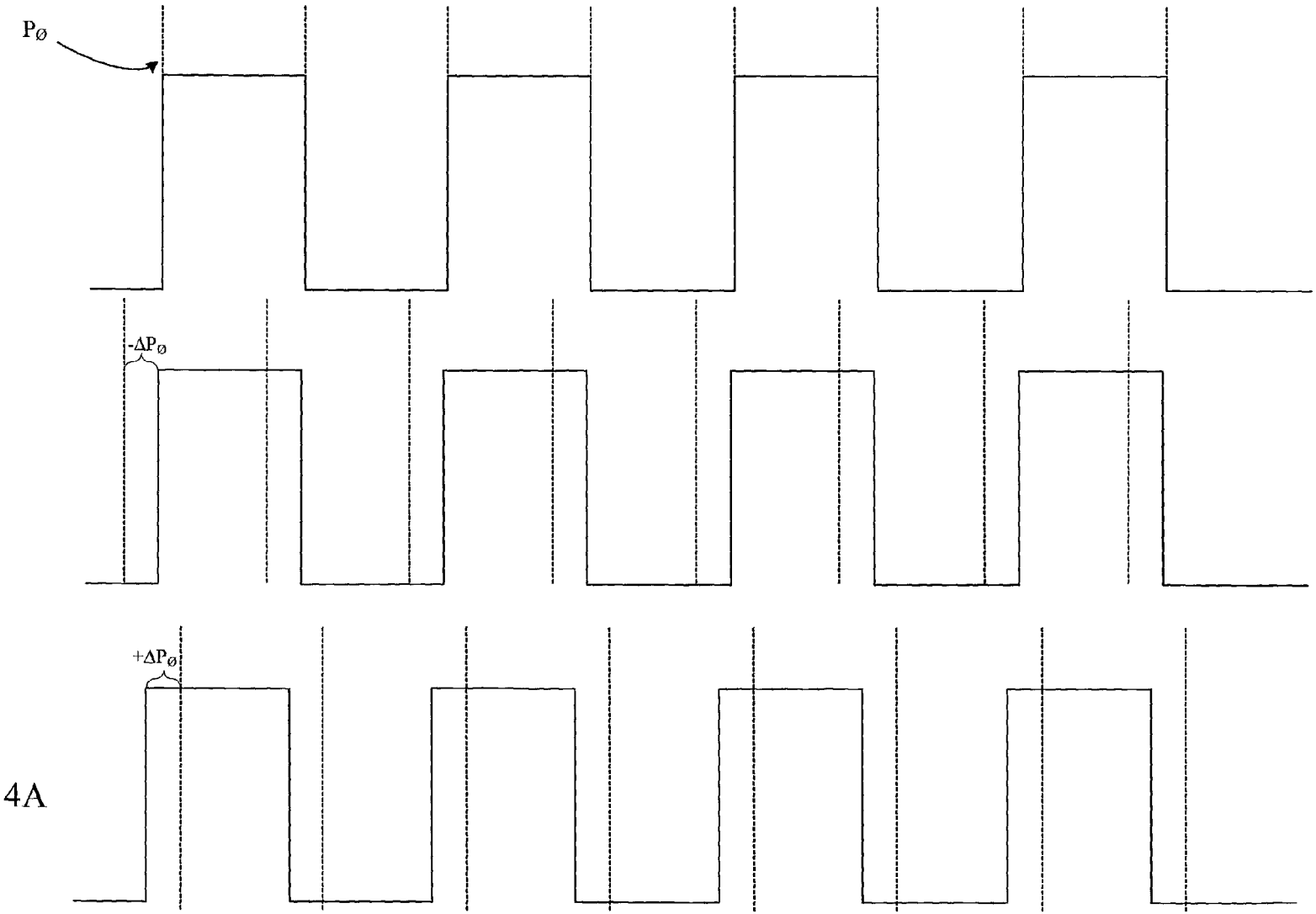
FIG. 4A graphically illustrates alignment of found features for a correct $H_{total}$ in accordance with an embodiment of the invention.
Figure 4B:
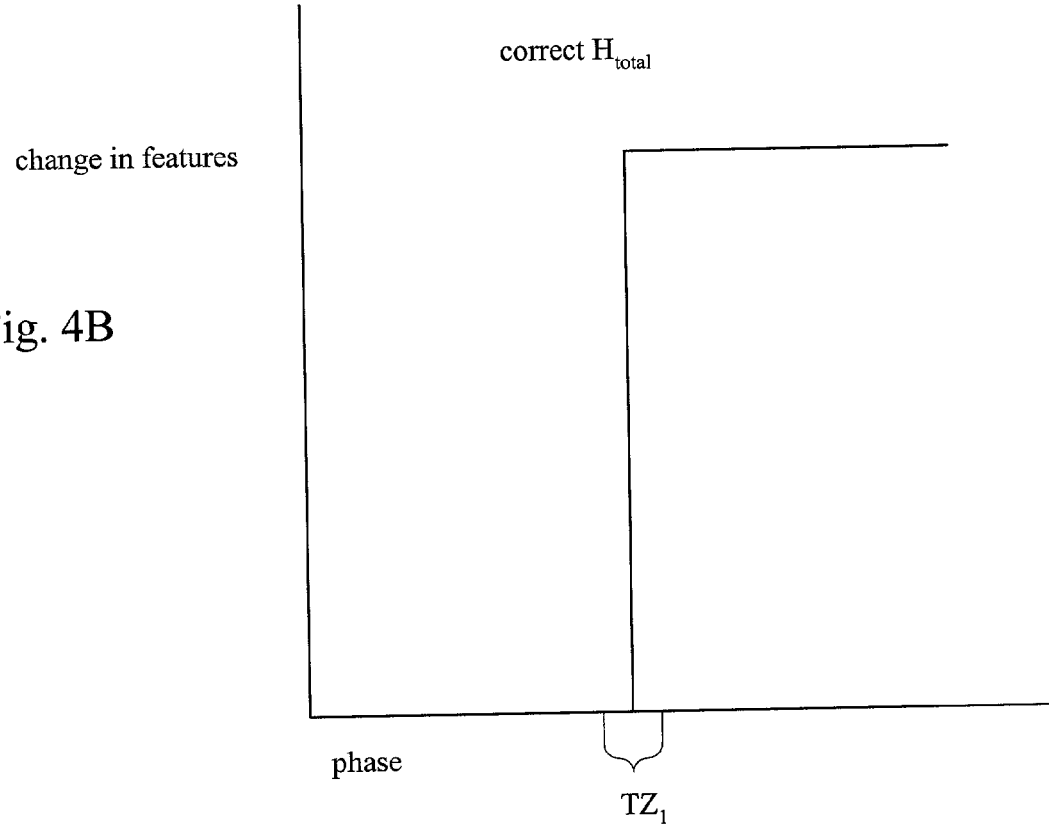
FIG. 4B illustrates a transition zone consistent with the correct $H_{total}$ of FIG. 4A.

Once the appropriate number of found features have been identified and their respective locations stored, a number of what are referred to as transition zones are measured by the transition zone detector 216. Since all features were created using the same pixel clock, when an estimated horizontal resolution $H_{TOTAL}$ is correct, then all features are aligned in such as way that when a pixel clock phase $P_{\varnothing}$ is varied, the number of found features that appear to move together approaches the number of found features. For example, referring to FIG. 4A, when the pixel clock phase $P_{\varnothing}$ is "true" (i.e., aligned with the edges of each of the found features), a variation $-\Delta P_{\varnothing}$ in pixel clock phase will result in the number of features sampled being zero whereas a variation $+\Delta P_{\varnothing}$ will result in the number of features sampled being substantially equal to the number of found features. This situation is graphically illustrated in FIG. 4B showing a transition zone $TZ_1$ corresponding to the situation illustrated in FIG. 4A where substantially all the found figures are aligned to $H_{TOTAL}$ and therefore the transition zone $TZ_1$ (defined as the range of pixel clock phases for a predetermined change in the number of found features) is a minimum.

Figure 5B:
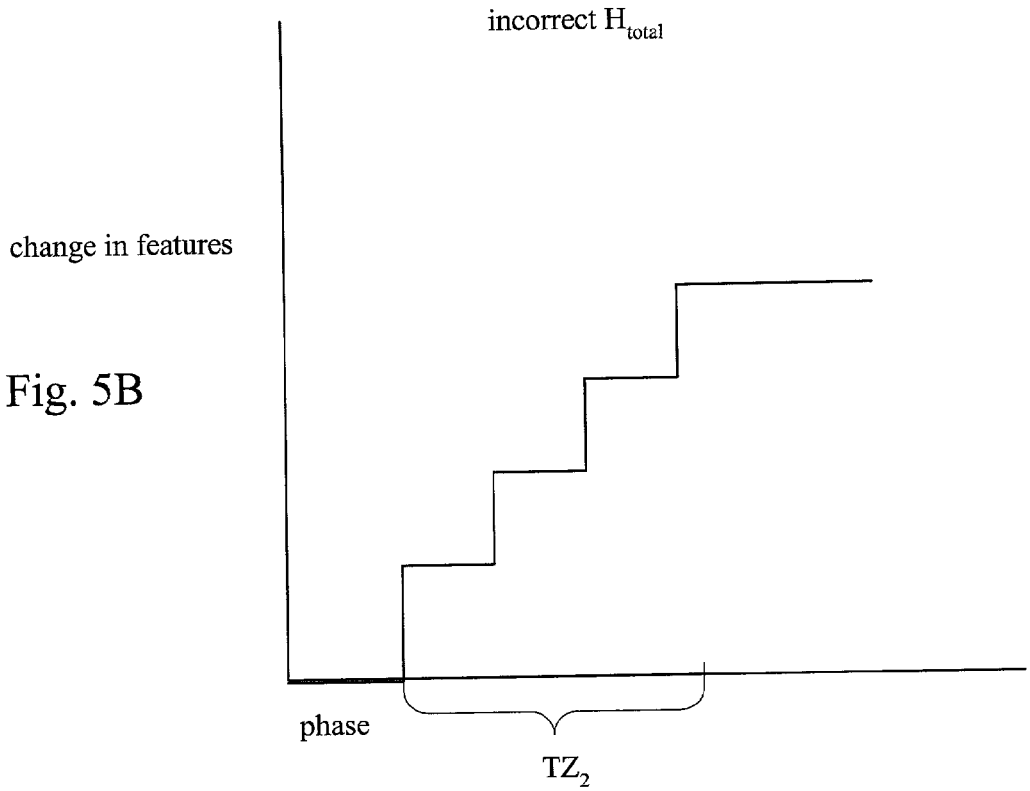
FIG. 5B illustrates a transition zone consistent with the incorrect $H_{total}$ of FIG. 5A.
Figure 5A:
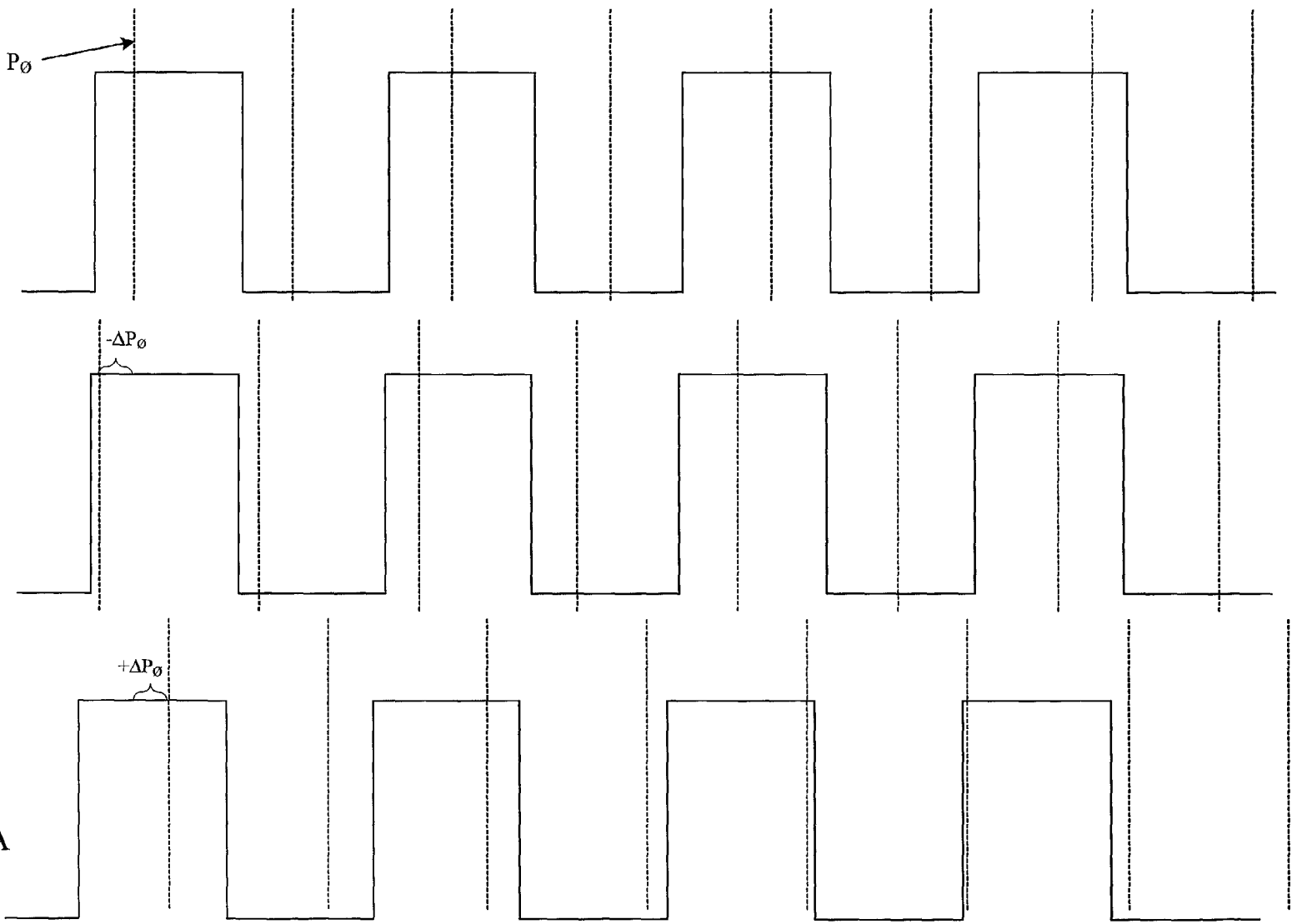
FIG. 5A graphically illustrates alignment of found features for an incorrect $H_{total}$ in accordance with an embodiment of the invention.

In the situation as shown in FIG. 5A where the horizontal resolution $H_{TOTAL}$ is incorrect, the found features do not all align and therefore any change in the number of found features that appear to move depends upon the pixel clock phase $P_{\varnothing}$. This particular situation is illustrated in FIG. 5B showing a transition zone $TZ_2$ that is substantially larger that the transition zone $TZ_1$. In this way, the most accurate estimate of the horizontal resolution is obtained by varying the horizontal resolution over a selected range and for each $H_{TOTAL}$ generate a corresponding transition zone by varying the pixel clock phase $P_{\varnothing}$ over a pre-determined pixel clock phase range of values (which in this example is $2\Delta P_{\varnothing}$). Once a set of transition zones has been generated and stored in a transition zone array, the minimum transition zone is determined which in turn corresponds to the best guess estimate of the horizontal resolution $H_{TOTAL}$.

Therefore, with reference to FIG. 1, the transition zone detector 216 includes a horizontal resolution scanner unit 230 arranged to provides a scan of a range of horizontal resolution values coupled to a feature tracker unit 232 that maintains the location of the found features. The feature tracker unit 232 updates the feature locations array during the scan of the horizontal resolutions by the horizontal resolution scanner unit 230. For each horizontal resolution value provided by the horizontal resolution scanner unit 230, a phase scanner unit 234 coupled to the feature tracker unit 232 varies the pixel clock phase $P_{\varnothing}$ over a predetermined range of phase values generating in the process a number of associated transition zones that are stored in the transition zone array 218. The minimum transition zone detector unit 220 coupled to the transition zone array 218, detects a minimum transition zone which is used to provide a horizontal resolution value $H_{TOTAL}$ consistent with the video signal 204.

Figure 6A:
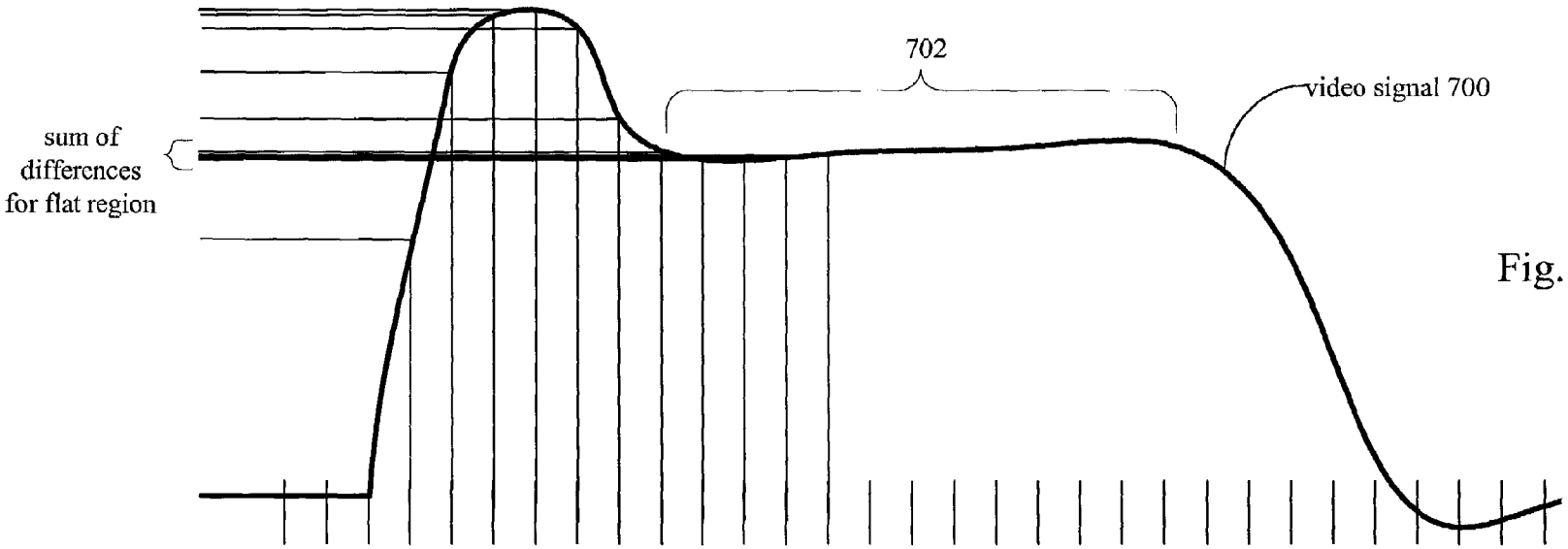
FIGS. 6A–6B graphically illustrate determining a flat region of a video signal in accordance with an embodiment of the invention.
Figure 6B:
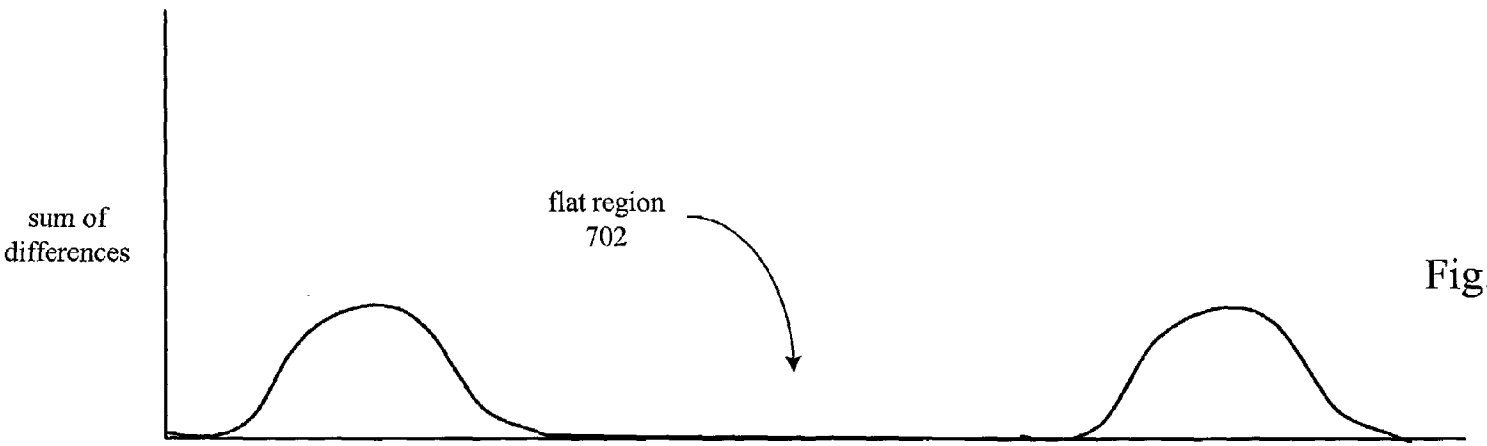

Still referring to FIG. 1, once the horizontal resolution $H_{TOTAL}$ value is generated, the horizontal estimator 206 provides the horizontal resolution value to the LCD 202 as well as the pixel clock phase estimator 222. The pixel clock phase estimator 222 estimates a pixel clock consistent with the video signal 204 with a flat region detector unit 240 by detecting a flat region of the video signal 204 as illustrated in FIG. 6A showing a representative video signal 700 based upon rising and falling edges stored in arrays 308 and 310, respectively. The flat region detector unit 240 performs a sum of differences operation at a specified number of locations on the video signal 700. A flat region 702 is defined as that region of the video signal 700 where the sum of differences for adjacent points is substantially zero, or in the alternative, below a predetermined value as graphically illustrated in FIG. 6B. Once the flat region 702 has been determined, at best phase unit 242 using a binary search approach, affixes the best phase as being that phase substantially in the middle of the flat region 702

Figure 7:
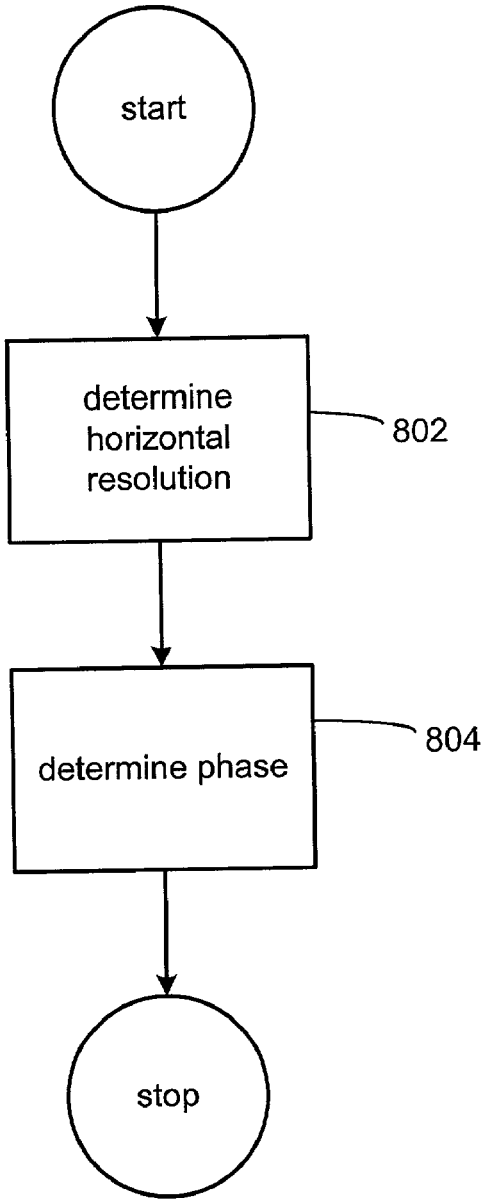
FIG. 7 describes a process for synchronizing an analog video signal to an LCD monitor in accordance with an embodiment of the invention.
Figure 8:
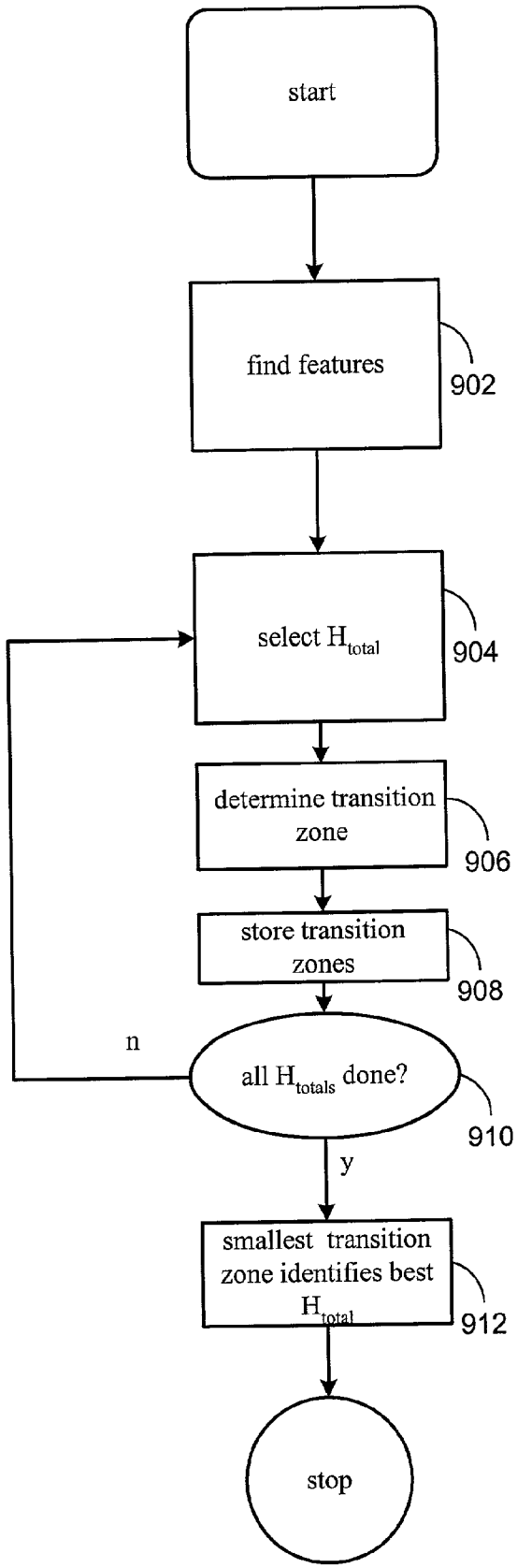
FIG. 8 illustrates a process for determining horizontal resolution in accordance with an embodiment of the invention.

FIGS. 7–13 describe a process 800 for synchronizing an analog video signal to an LCD monitor in accordance with an embodiment of the invention. As shown in FIG. 7, the process 800 begins at 802 by determining a horizontal resolution and at 804 by determining a phase based in part upon the determined horizontal resolution. FIG. 8 illustrates a process 900 for determining horizontal resolution in accordance with an embodiment of the invention. The process 900 begins at 902 by finding features and at 904 by selecting a range of horizontal resolutions. At 906, for each of the range of horizontal resolutions, a transition zone is measured for each found features each of which is stored at 908. At 910, a determination is made whether or not all of the range of horizontal resolutions have been completed. If it has been determined that not all of the range of horizontal resolutions have been used, control is passed back to 904, otherwise, a smallest transition zone is determined at 912 which identifies a best horizontal resolution.

Figure 9:
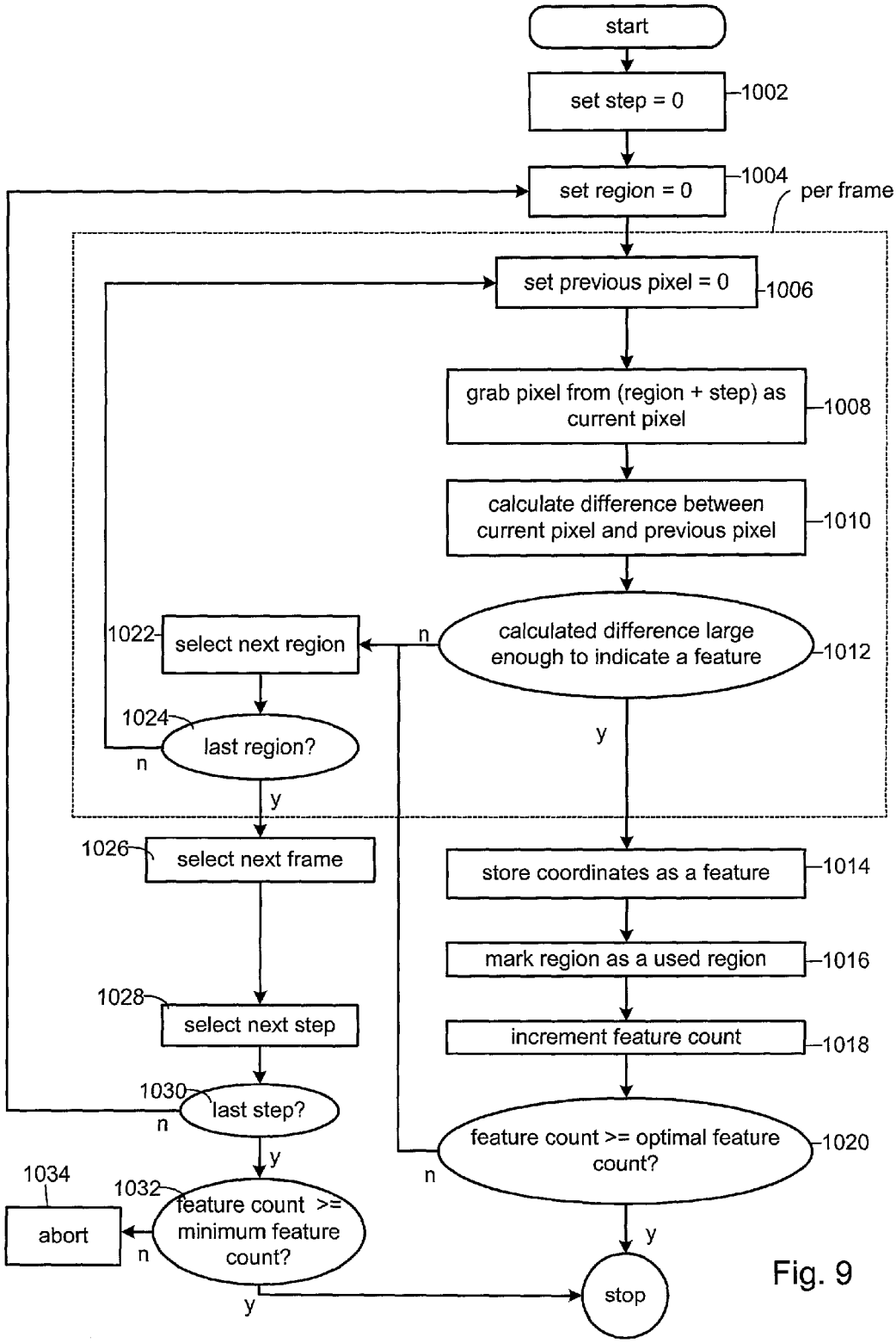
FIG. 9 illustrates a process for finding a feature in accordance with an embodiment of the invention.

FIG. 9 illustrates a process 1000 for finding a feature in accordance with an embodiment of the invention. The process 1000 begins at 1002 by setting step equal to zero and at 1004 by setting a region equal to zero. At 1006, a previous pixel value is set equal to zero while at 1008, a pixel value is grabbed from a location determined by region plus step and identified as a current pixel. At 1010, a difference between the current pixel and the previous pixel is calculated while at 1012, a determination is made if the calculated difference is great enough to indicate a feature. If it is determined that the calculated difference does indicate a feature, then the found features are stored and identified as a feature at 1014 while at 1016, the region is marked as a used region and the feature count is updated at 1018. At 1020, a determination is made whether or not the feature count is greater than or equal to an optimal feature count. If it is so determined that the feature count is greater than or equal to the optimal feature count, then the process 1000 stops, otherwise, a next region is selected at 1022.

Returning back to 1012, if it had been determined that the calculated difference is not great enough to indicate a feature, then control is passed directly to 1022 and at 1024, a determination is made whether or not the selected region is a last region. If the selected region is not a last region, then control is passed back to 1006, otherwise, a next frame is selected at 1026 and a next step is selected at 1028. At 1030, a determination is made whether or not the selected step is a last step, which if it is not, then control is passed to 1004, otherwise, a determination is made at 1032 whether or not the feature count is greater than or equal to a minimum feature count. If the feature count is not greater than or equal to the minimum feature count, then the process 1000 is aborted at 1034, otherwise, the process 1000 stops normally.

Figure 10:
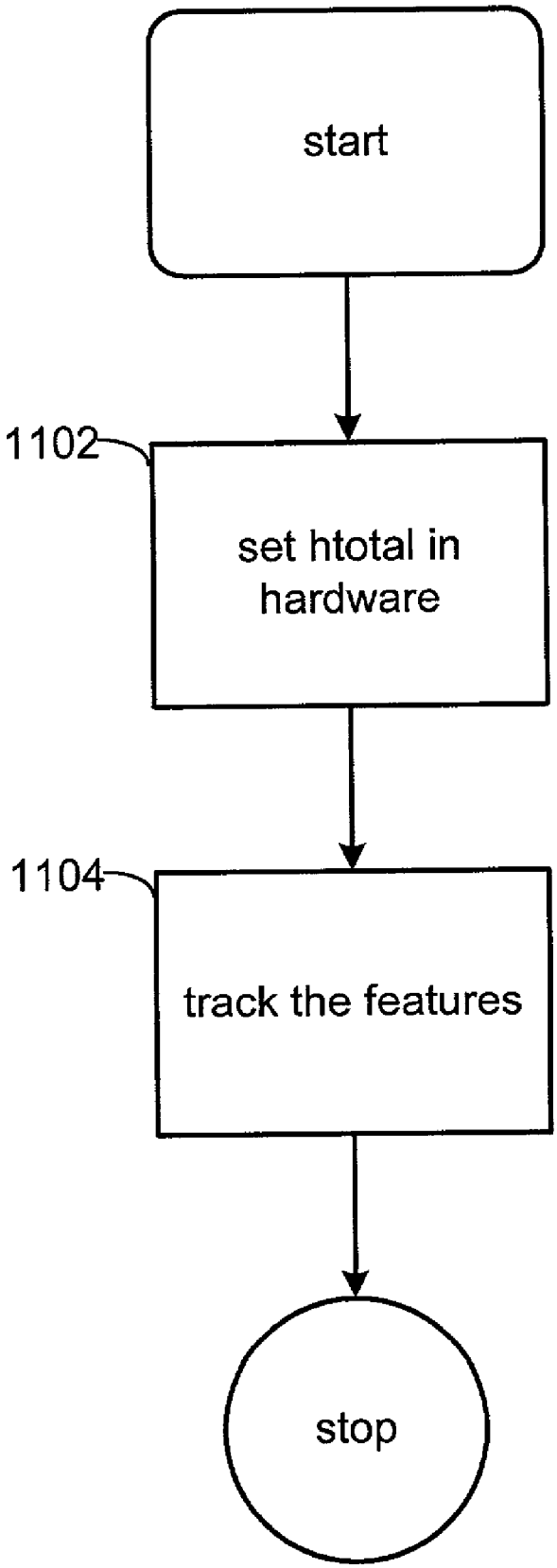
FIG. 10 describes a process for selecting horizontal resolution $H_{TOTAL}$ in accordance with an embodiment of the invention.

FIG. 10 describes a process 1100 for selecting horizontal resolution $H_{TOTAL}$ in accordance with an embodiment of the invention. The process 1100 begins at 1102 where the horizontal resolution is set to a default horizontal resolution (typically corresponding to standard resolutions such as 480×640, etc.) and the features are then tracked at 1104. By tracking, it is meant that whenever the horizontal resolution is varied, the number of features will vary, or appear to move. In order to maintain the true number of found features independent of the variation of horizontal resolution (in order to ascertain the change in the number of found features due solely to the pixel clock phase $P_{\varnothing}$), the number of features are tracked as described below.

Figure 11:
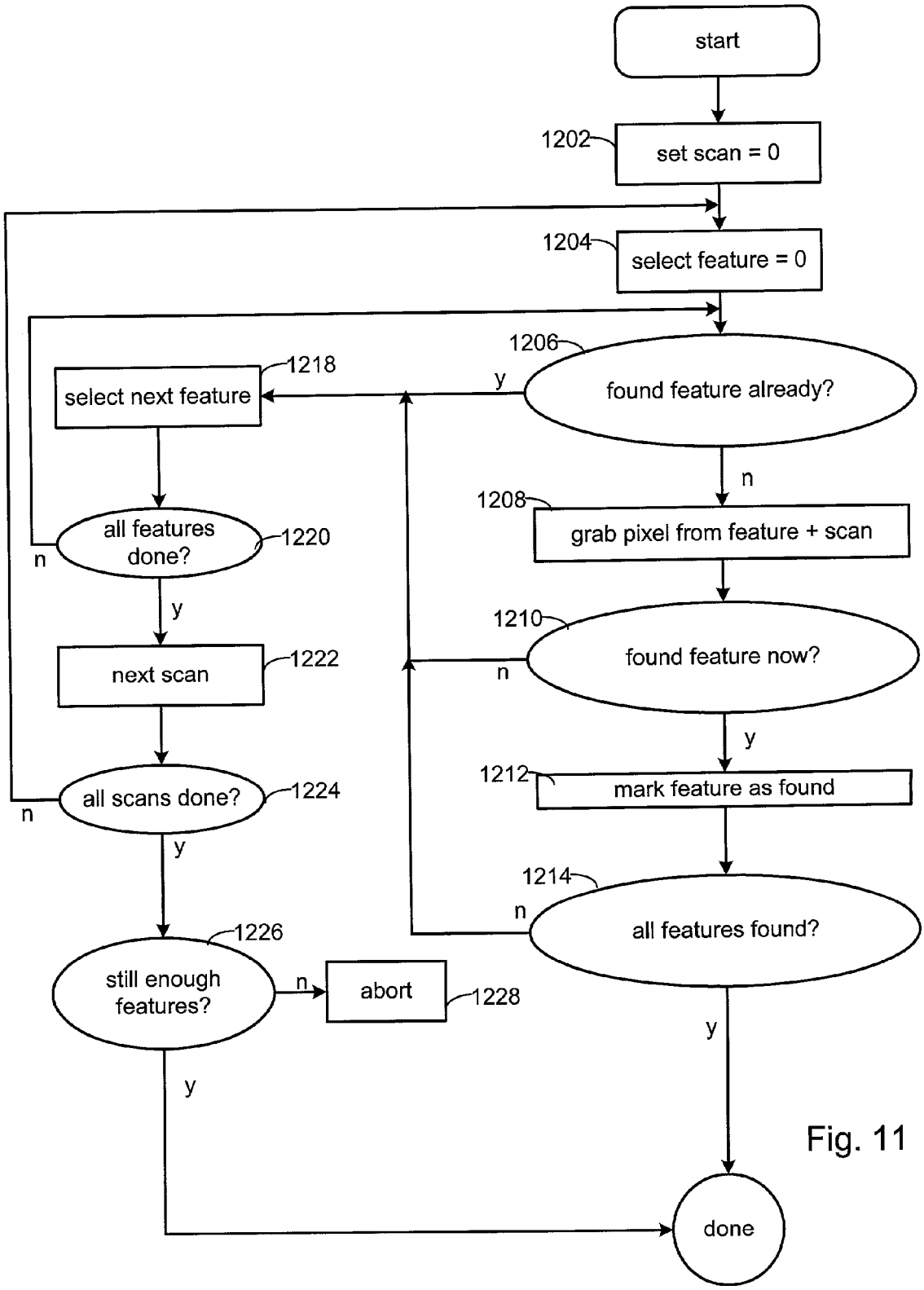
FIG. 11 shows a flowchart detailing a process for tracking features in accordance with an embodiment of the invention.

FIG. 11 shows a flowchart detailing a process 1200 for tracking features in accordance with an embodiment of the invention. The process 1200 begins at 1202 by setting a scan variable equal to zero and at 1204 by setting a feature count at zero at 1206. Next, at 1208, a determination is made whether or not the feature is a found feature or not. If the feature is not a found feature, then a pixel from location corresponding to feature count plus the scan variable at 1210 while at 1212, a determination is made whether or not the feature is found. If the feature is determined to be found, then the feature is marked as found and a determination at 1216 is then made to determine whether or not all features have been found. If all features have been found, then the process 1200 stops, otherwise control is passed to 1218 where a next feature is selected. Returning to 1208, if the feature was a found feature, then control is passed to 1018. Returning to 1212, if the feature was a found feature, then control is passed to 1018.

Returning to 1018, control is then passed to 1020 where a determination is made whether or not all features have been done. If all features have not been done, then control is passed back to 1208, otherwise, a next scan is done at 1022 while at 1024, a determination is made whether or not all scans have been done. If all scans have been done, then control is passed to 1206, otherwise, a determination is made at 1026 whether or not there are enough features. If there are not enough features, then the process 1200 aborts, otherwise the process 1200 stops normally.

Figure 12:
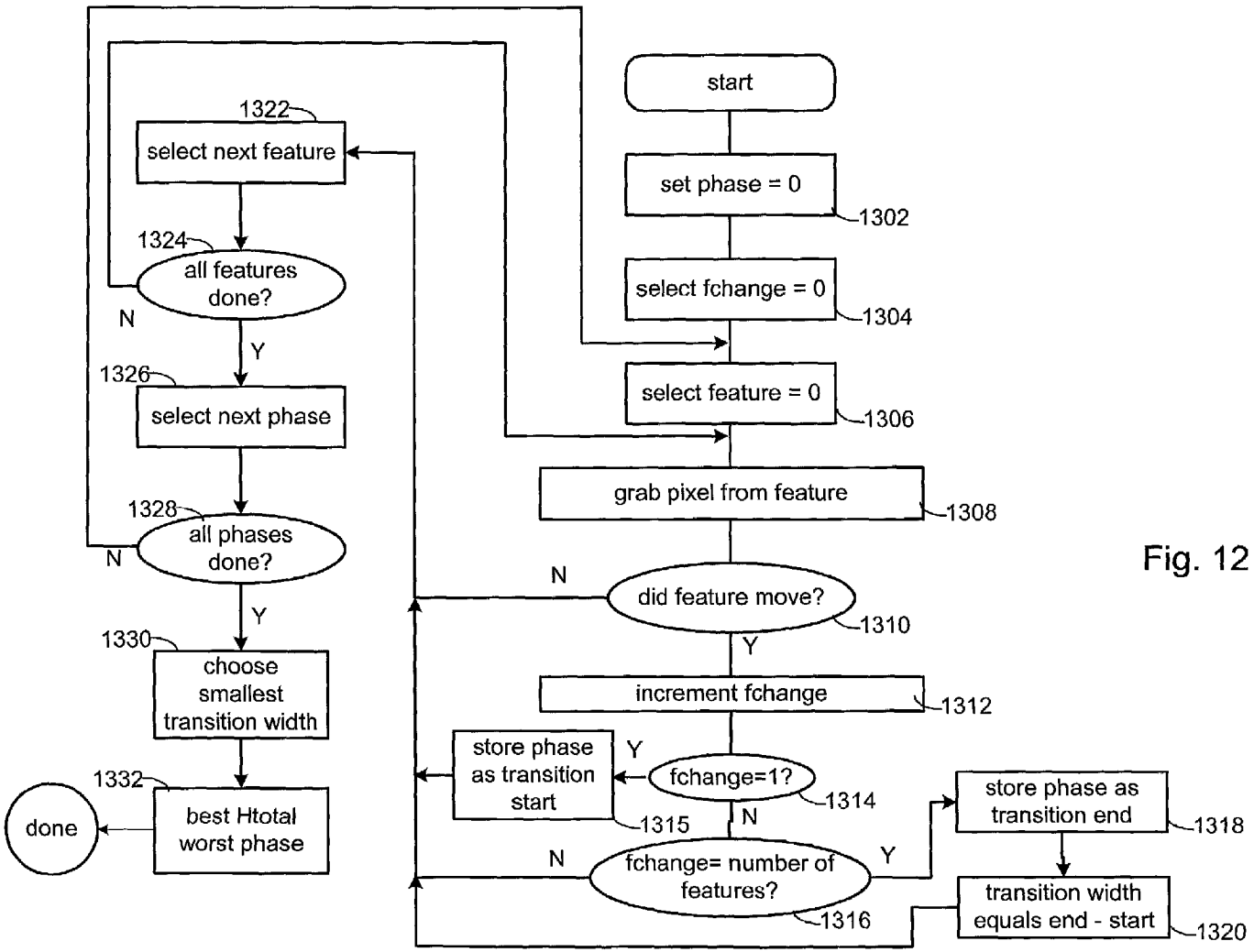
FIG. 12 shows a flowchart detailing a process for measuring a transition zone in accordance with an embodiment of the invention.

FIG. 12 shows a flowchart detailing a process 1300 for measuring a transition zone in accordance with an embodiment of the invention. The process 1300 begins at 1302 by setting a phase equal to zero and at 1304 by setting a feature change (fchange) variable equal to zero. At 1306, a feature variable is set to zero, while at 1308, a pixel is grabbed from the feature and a determination is made at 1310, whether or not the feature moved. If the feature did move, then at 1312, fchange is incremented and a determination is made at 1314 if fchange is equal to one. If fchange is equal to one, then the phase is stored as a transition start at 1315 and control is passed to 1322 where a next feature is selected whereas if not equal to one, then a determination is made at 1316 if fchange is equal to the number of features. If fchange is equal to the number of features, then the phase is stored as a transition end at 1318 and a transition width is set equal to transition end minus transition start at 1320, otherwise control is passed to 1322. Returning back to 1310, if the feature did not move, then control is passed directly to 1322.

At 1324, a determination is made whether or not all features have been done and if not, then control is passed directly to 1306, otherwise, a next phase is selected at 1326 followed by a determination at 1328 whether all phases have been done. If all phases have been done, then a smallest transition width is selected at 1330 which is associated with a best horizontal resolution, worst phase at 1332.

Figure 13:
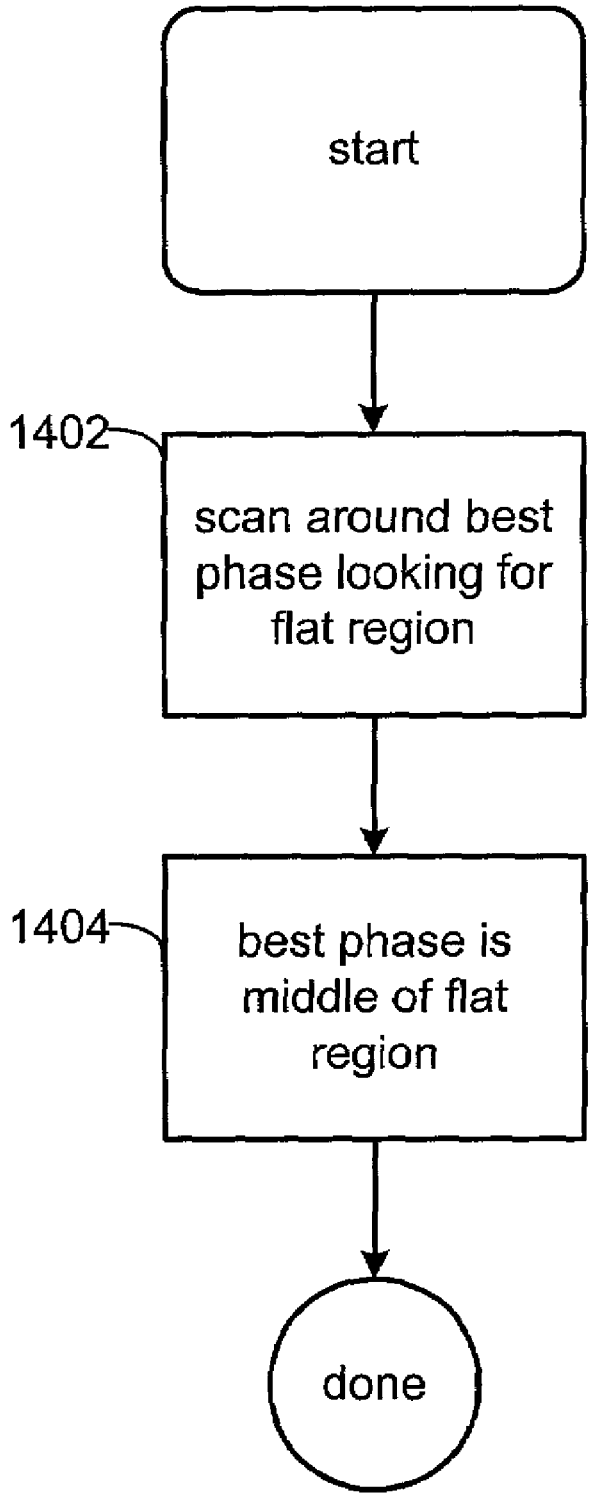
FIG. 13 shows a flowchart detailing a process for determining a phase in accordance with an embodiment of the invention.

FIG. 13 shows a flowchart detailing a process 1400 for determining a phase in accordance with an embodiment of the invention. The process 1400 begins at 1402 scanning around in order to determine a flat region at setting a best phase at the middle of the flat region at 1404.

Figure 14:
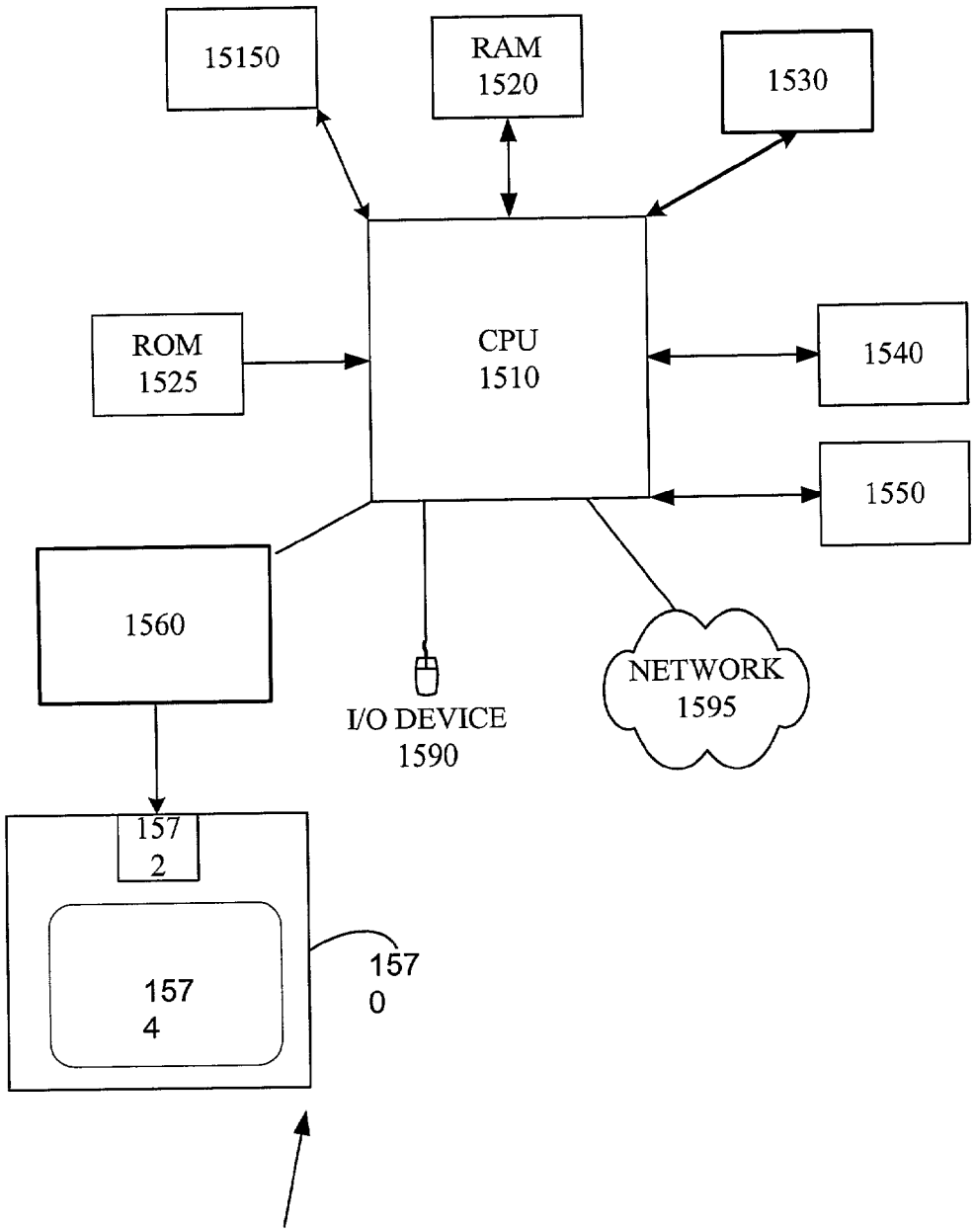
FIG. 14 illustrates a computer system employed to implement the invention.

FIG. 14 illustrates a computer system 1500 employed to implement the invention. Computer system 1500 is only an example of a graphics system in which the present invention can be implemented. Computer system 1500 includes central processing unit (CPU) 810, random access memory (RAM) 1520, read only memory (ROM) 1525, one or more peripherals 1530, graphics controller 1560, primary storage devices 1540 and 1550, and digital display unit 1570. As is well known in the art, ROM acts to transfer data and instructions uni-directionally to the CPUs 810, while RAM is used typically to transfer data and instructions in a bi-directional manner. CPUs 810 may generally include any number of processors. Both primary storage devices 1540 and 1550 may include any suitable computer-readable media. A secondary storage medium 880, which is typically a mass memory device, is also coupled bi-directionally to CPUs 1510 and provides additional data storage capacity. The mass memory device 880 is a computer-readable medium that may be used to store programs including computer code, data, and the like. Typically, mass memory device 880 is a storage medium such as a hard disk or a tape which generally slower than primary storage devices 1540, 1550. Mass memory storage device 880 may take the form of a magnetic or paper tape reader or some other well-known device. It will be appreciated that the information retained within the mass memory device 880, may, in appropriate cases, be incorporated in standard fashion as part of RAM 1520 as virtual memory.

CPUs 1510 are also coupled to one or more input/output devices 890 that may include, but are not limited to, devices such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPUs 1510 optionally may be coupled to a computer or telecommunications network, e.g., an Internet network or an intranet network, using a network connection as shown generally at 895. With such a network connection, it is contemplated that the CPUs 1510 might receive information from the network, or might output information to the network in the course of performing the above-described method steps. Such information, which is often represented as a sequence of instructions to be executed using CPUs 1510, may be received from and outputted to the network, for example, in the form of a computer data signal embodied in a carrier wave. The above-described devices and materials will be familiar to those of skill in the computer hardware and software arts.

Graphics controller 1560 generates analog image data and a corresponding reference signal, and provides both to digital display unit 1570. The analog image data can be generated, for example, based on pixel data received from CPU 1510 or from an external encode (not shown). In one embodiment, the analog image data is provided in RGB format and the reference signal includes the VSYNC and HSYNC signals well known in the art. However, it should be understood that the present invention can be implemented with analog image, data and/or reference signals in other formats. For example, analog image data can include video signal data also with a corresponding time reference signal.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

While this invention has been described in terms of a preferred embodiment, there are alterations, permutations, and equivalents that fall within the scope of this invention. It should also be noted that there are may alternative ways of implementing both the process and apparatus of the present invention. It is therefore intended that the invention be interpreted as including all such alterations, permutations, and equivalents as fall within the true spirit and scope of the present invention.

What is claimed is:

1. An apparatus for synchronizing an analog video signal formed of a plurality of associated video frames to a digital image formed of a plurality of pixels displayed on a digital display unit, comprising:

means for determining a synchronizing horizontal resolution (Htotal) that includes, means for finding a plurality of features for a selected one of a range of Htotal;

means for tracking each of the plurality of features for each of the range of Htotal;

means for measuring a transition zone for each of the plurality of found features for each of the range of Htotal;

means for determining the narrowest transition zone of the plurality of transition zones, and means for associating a particular one of the range of Htotal corresponding to the narrowest transition zone to the synchronizing horizontal resolution; and means for determining a synchronizing phase coupled to the means for determining the synchronizing horizontal resolution that includes, means for selecting an estimated phase based upon the synchronizing horizontal resolution;

means for determining a flat region of a video signal corresponding to a selected found feature, and means for selecting the synchronizing phase based upon the flat region.

2. An apparatus as recited in claim 1, wherein the means for finding comprises:

means for initializing a step value, a region value, and a previous pixel value to a corresponding initial value;

means for grabbing a pixel value at a location corresponding to the step value plus the region value;

means for setting a current pixel value as the grabbed pixel value; and means for subtracting the current pixel value from the previous pixel value to form a pixel value difference.

3. An apparatus as recited in claim 2, wherein the means for finding further comprises:

means for determining if the pixel value difference indicates a found feature;

means for storing a set of pixel coordinates as a feature based upon the location;

marking the region as a used region;

incrementing a feature count; and determining if the feature count is greater than or equal to a pre-selected feature count.

4. An apparatus as recited in claim 1, wherein the means for tracking comprises:

means for initializing a scan value, a feature value to a corresponding initial value;

means for determining if a feature is a found feature;

means for grabbing a pixel value from a location corresponding to the feature value and the scan value if it is determined that the feature is a not found feature;

means for determining if the feature is a found feature;

means for marking the feature as found; and means for determining if all features are found.

5. A method of synchronizing an analog video signal formed of a plurality of associated video frames to a digital image formed of a plurality of pixels displayed on a digital display unit, comprising:

determining a synchronizing horizontal resolution (Htotal) by, finding a plurality of features for a selected one of a range of Htotal;

tracking each of the plurality of features for each of the range of Htotal;

measuring a transition zone for each of the plurality of found features for each of the range of Htotal;

determining the narrowest transition zone of the plurality of transition zones, and associating a particular one of the range of Htotal corresponding to the narrowest transition zone to the synchronizing horizontal resolution; and determining a synchronizing phase coupled to the means for determining the synchronizing horizontal resolution by, selecting an estimated phase based upon the synchronizing horizontal resolution;

determining a flat region of a video signal corresponding to a selected found feature, and selecting the synchronizing phase based upon the flat region.

6. A method as recited in claim 5, wherein the finding comprises:

initializing a step value, a region value, and a previous pixel value to a corresponding initial value;

grabbing a pixel value at a location corresponding to the step value plus the region value;

setting a current pixel value as the grabbed pixel value; and subtracting the current pixel value from the previous pixel value to form a pixel value difference.

7. A method as recited in claim 6, wherein the means for finding further comprises:

determining if the pixel value difference indicates a found feature;

storing a set of pixel coordinates as a feature based upon the location;

marking the region as a used region;

incrementing a feature count; and determining if the feature count is greater than or equal to a pre-selected feature count.

8. A method as recited in claim 5, wherein the means for tracking comprises:

initializing a scan value, a feature value to a corresponding initial value;

determining if a feature is a found feature;

grabbing a pixel value from a location corresponding to the feature value and the scan value if it is determined that the feature is a not found feature;

determining if the feature is a found feature;

marking the feature as found; and means for determining if all features are found.

9. A method as recited in claim 5, wherein the measuring a transition zone comprises:

initializing a phase, a feature value, and a feature change value to a corresponding initial value;

selecting one of the plurality of found features;

grabbing a pixel from the selected feature;

determining if the selected feature moved;

if the selected feature moved, then incrementing the feature change value; and if the feature change value is equal to 1, then storing the phase as a transition start value.

10. A method as recited in claim 9, wherein the measuring further comprises:

if the feature change in not equal to 1, then determining if the feature change value is equal to the feature value;

if the feature change value is equal to the feature value, then storing the phase as a transition end value; and subtracting the transition start value from the transition end value.

11. An analog to digital synchronizer for synchronizing an analog video signal formed of a plurality of associated video frames to a digital image formed of a plurality of pixels displayed on a digital display unit, comprising:

a video signal evaluator arranged to provide an estimate of the synchronizing resolution;

a feature finder unit arranged to find a feature, if any, associated with a pseudo-randomly selected pixel;

a transition zone generator unit coupled to the feature finder unit arranged to generate a transition zone associated with the found feature based upon the estimated synchronizing resolution; and a minimum transition zone evaluator unit coupled to the transition zone detector for evaluating a minimum transition zone corresponding to the synchronizing resolution.

12. An apparatus as recited in claim 11, wherein the pseudo-randomly selected pixel is one of a plurality of pseudo-randomly selected pixels in a video frame each of which is associated with a region of the video frame.

13. An apparatus as recited in claim 12, wherein each of the regions is formed of a group of associated pixels.

14. An apparatus as recited in claim 13, wherein the group of associated pixels is a group of associated horizontal pixels.

15. An apparatus as recited in claim 14, wherein the synchronizing resolution is a horizontal resolution formed of a total number of horizontal pixels that span the displayed video frame.

16. An apparatus as recited in claim 15 wherein the feature finder comprises:

a horizontal resolution scanner unit arranged to provide a range of horizontal resolutions based upon the estimated horizontal resolution;

a feature tracker unit coupled to the horizontal resolution scanner unit arranged to track the found feature for each of the range of horizontal resolutions; and a phase scanner unit coupled to the feature tracker unit arranged to provide a range of phases based upon the estimated resolution.

17. An apparatus as recited in claim 16, wherein the transition zone generator comprises:

a found feature counter unit arranged to provide a number of found features for each of the range of phases; and a found feature accumulator unit coupled to the found feature counter unit arranged to provide a change in the number of found features corresponding to the range of phases, wherein the transition zone spans the range of phases corresponding to the change in the number of found features substantially equal to the total number of found features.

* * * * *